United States Patent [19]

Ito

[11] Patent Number: 4,720,730

[45] Date of Patent: Jan. 19, 1988

[54] IMAGE FORMING APPARATUS WITH A PLURALITY OF DEVELOPING MEANS

[75] Inventor: Masazumi Ito, Toyohashi, Japan

[73] Assignee: Minolta Camera Kabushiki Kaisha, Osaka, Japan

[21] Appl. No.: 803,677

[22] Filed: Dec. 2, 1985

[30] Foreign Application Priority Data

| | | | |
|---|---|---|---|
| Nov. 30, 1984 | [JP] | Japan | 59-254588 |
| Dec. 15, 1984 | [JP] | Japan | 59-265074 |
| Dec. 18, 1984 | [JP] | Japan | 59-267059 |
| Dec. 18, 1984 | [JP] | Japan | 59-267060 |

[51] Int. Cl.[4] ..... G03G 15/00; G03G 15/08

[52] U.S. Cl. ..... 355/4; 355/3 DD; 355/14 D

[58] Field of Search ..... 355/4, 3 R, 3 DD, 14 D, 355/14 R; 271/9

[56] References Cited

U.S. PATENT DOCUMENTS

| | | | |
|---|---|---|---|
| 3,926,517 | 12/1975 | Nagahara | 355/3 DD |
| 3,960,445 | 6/1976 | Drawe | 355/4 |
| 4,222,660 | 9/1980 | Furuichi et al. | 355/14 R |
| 4,264,185 | 4/1981 | Ohta | 355/4 |
| 4,386,769 | 6/1983 | Ito et al. | 271/9 |
| 4,416,533 | 11/1983 | Tokunaga et al. | 355/4 |
| 4,447,145 | 5/1984 | Snelling et al. | 355/14 D |
| 4,451,134 | 5/1984 | Fukuchi et al. | 355/14 D X |
| 4,536,080 | 8/1985 | Hauser et al. | 355/14 D |

*Primary Examiner*—A. C. Prescott

*Attorney, Agent, or Firm*—Burns, Doane, Swecker & Mathis

[57] ABSTRACT

In the present invention, there is disclosed an image forming apparatus in which an electrostatic latent image formed on a photosensitive member is developed and subsequently transferred to a paper. The apparatus comprises a plurality of developing devices selectively operable to develop the electrostatic latent image, an agitator provided in each of the developing devices for agitating developer contained therein, and a device responsive to a power switch for driving each of the agitators for a predetermined period of time. One of the developing devices is driven to develop the electrostatic latent image during an image forming cycle. Another device is responsive to termination of the image forming cycle for at least driving the agitators of the developing devices not used in the image forming cycle for a predetermined period of time.

5 Claims, 25 Drawing Figures

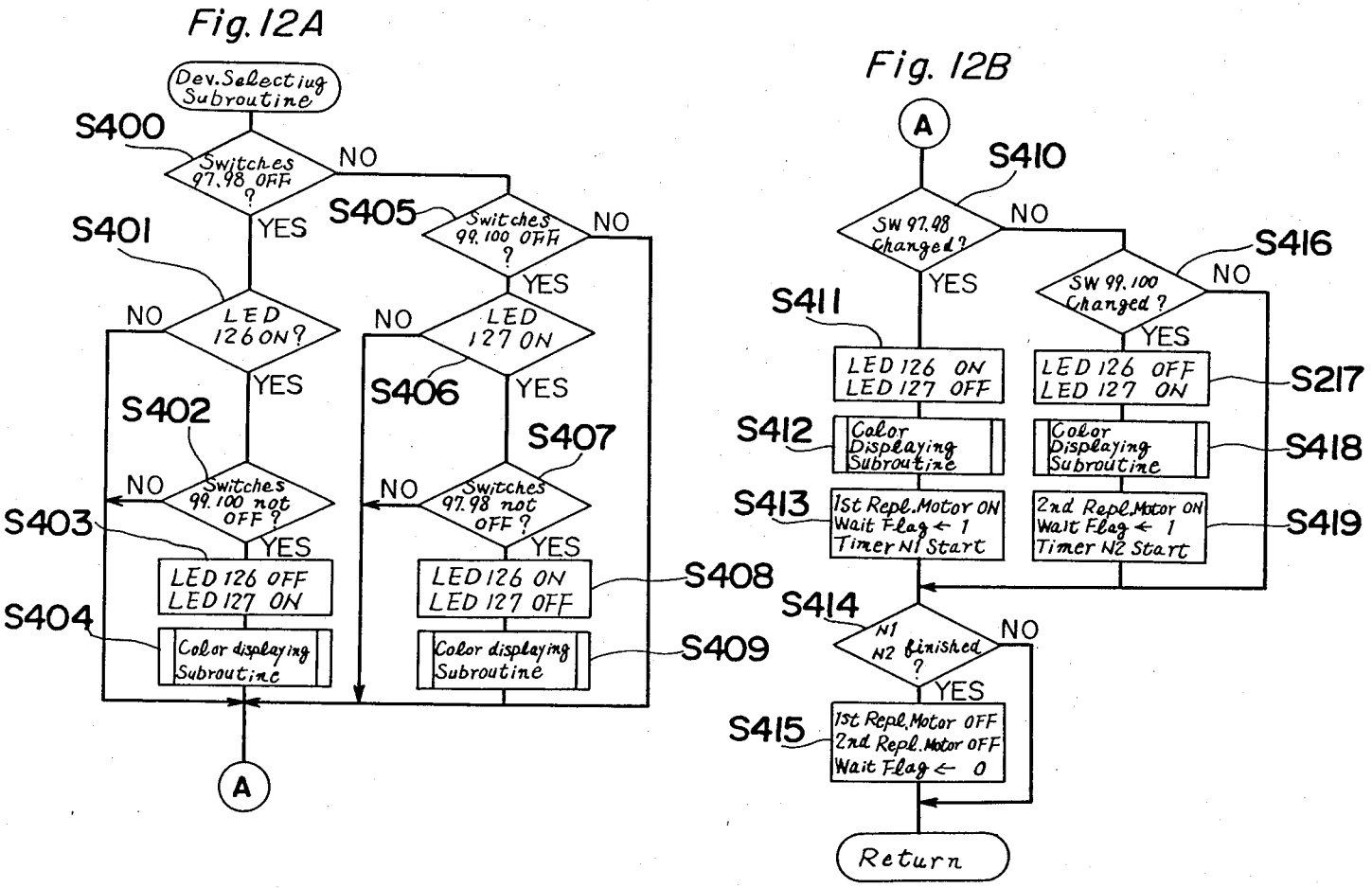
Fig. 12A
Dev. Selecting Subroutine
Switches 97.98 OFF ?
S400
NO
YES
LED 126 ON ?
S401
NO
YES
Switches 99.100 not OFF ?
S402
NO
YES
LED 126 OFF LED 127 ON
S403
Color displaying Subroutine
S404
Switches 99.100 OFF ?
S405
NO
YES
LED 127 ON
S406
NO
YES
Switches 97.98 not OFF ?
S407
NO
YES
LED 126 ON LED 127 OFF
S408
Color displaying Subroutine
S409
A
Fig. 12B
A
Sw 97.98 Changed ?
S410
NO
YES
LED 126 ON LED 127 OFF
S411
Color Displaying Subroutine
S412
1st Repl. Motor ON Wait Flag ← 1 Timer N1 Start
S413
Sw 99.100 Changed ?
S416
NO
YES
LED 126 OFF LED 127 ON
S217
Color Displaying Subroutine
S418
2nd Repl. Motor ON Wait Flag ← 1 Timer N2 Start
S419
N1 N2 finished ?
S414
NO
YES
1st Repl. Motor OFF 2nd Repl. Motor OFF Wait Flag ← 0
S415
Return

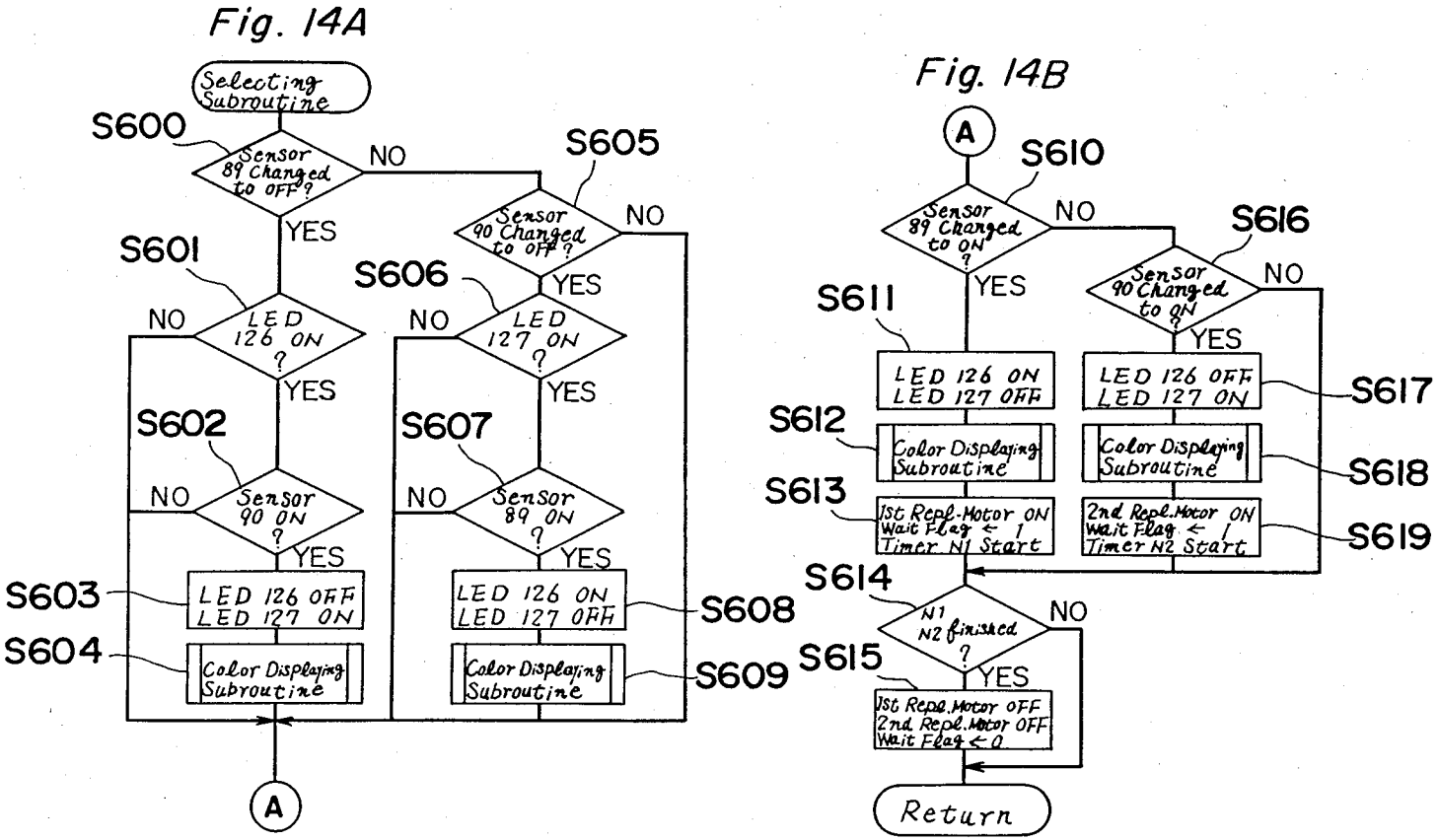
Fig. 14A
Selecting Subroutine
Sensor 89 Changed to OFF?
Sensor 90 Changed to OFF?
LED 126 ON ?
LED 127 ON ?
Sensor 90 ON ?
Sensor 89 ON ?
LED 126 OFF LED 127 ON
LED 126 ON LED 127 OFF
Color Displaying Subroutine
YES
NO
S600
S601
S602
S603
S604
S605
S606
S607
S608
S609
A
Fig. 14B
Sensor 89 Changed to ON ?
Sensor 90 Changed to ON ?
N1 N2 finished ?
1st Repd. Motor ON Wait Flag ← 1 Timer N1 Start
2nd Repd. Motor ON Wait Flag ← 1 Timer N2 Start
1st Repd. Motor OFF 2nd Repd. Motor OFF Wait Flag ← 0
Return
S610
S611
S612
S613
S614
S615
S616
S617
S618
S619

Tonor Displaying Subroutine 8
S701
Key 124 ON?
NO
YES
S702
Sensor 89 ON?
NO
YES
S703
LED 126 ON
LED 127 OFF
Color Displaying Subroutine
S704
LED 126 OFF
S705
S706
Key 125 ON?
NO
YES
S707
Sensor 90 ON?
NO
YES
S708
LED 126 OFF
LED 127 ON
Color Displaying Subroutine
S709
LED 127 OFF
S710
A A
S711
LED 126 ON?
NO
YES
S712
Sensor 91 ON?
NO
YES
S713
LED 132 OFF
S714
LED 132 ON
S715
LED 127 ON?
NO
YES
S716
Sensor 92 ON?
NO
YES
S717
LED 132 OFF
S718
LED 132 ON
Return

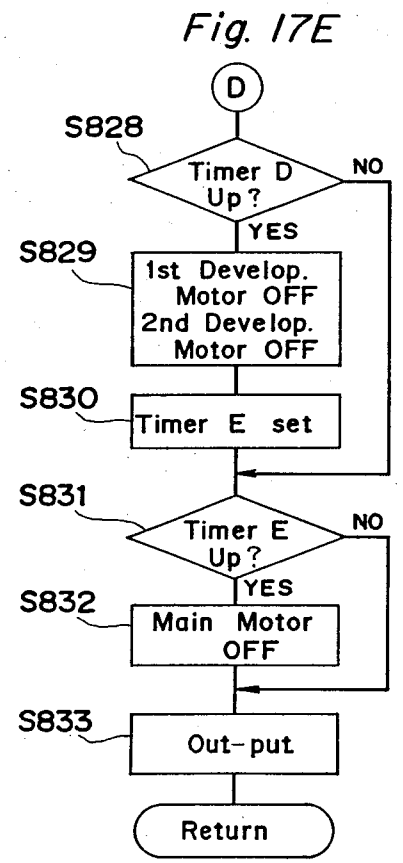
Fig. 17E
D
Timer D Up?
NO
YES
S828
1st Develop. Motor OFF
2nd Develop. Motor OFF
S829
Timer E set
S830
Timer E Up?
NO
YES
S831
Main Motor OFF
S832
Out-put
S833
Return

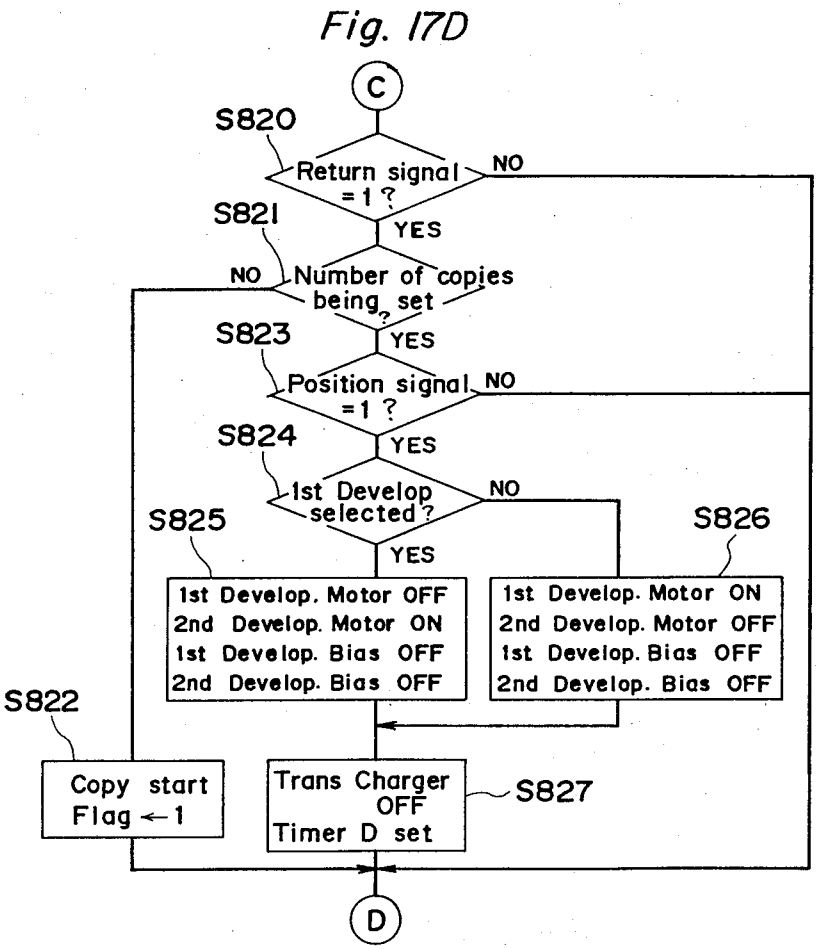
Fig. 17D
C
Return signal =1 ?
NO
YES
S820
Number of copies being set
NO
YES
S821
Position signal =1 ?
NO
YES
S823
1st Develop selected?
NO
YES
S824
1st Develop. Motor ON
2nd Develop. Motor OFF
1st Develop. Bias OFF
2nd Develop. Bias OFF
S826
1st Develop. Motor OFF
2nd Develop. Motor ON
1st Develop. Bias OFF
2nd Develop. Bias OFF
S825
Trans Charger OFF
Timer D set
S827
Copy start Flag ← 1
S822
D

IMAGE FORMING APPARATUS WITH A PLURALITY OF DEVELOPING MEANS

BACKGROUND OF THE INVENTION

1. Field of the Invention

The present invention is related to an image forming apparatus such as a copying machine, a printing machine and the like which provides a plurality of developing devices therein.

2. Description of the Prior Art

There has been known an image forming apparatus with a plurality of developing devices. In an image forming apparatus of this type, a plurality of developing devices are arranged circumferentially around an image forming drum which are selectively used to obtain a copy of a desired color such as black, red and/or green etc.

In such an image forming apparatus, the developing device containing black toner is used frequently since black color is ordinarily designated by the user. Therefore, the fluidity of developer contained therein is maintained in a good state.

Contrary to the above, since the developing device containing color toner other than black is driven not so often as compared with the developing device for black toner, developer contained therein is apt to be coagulated by the ambient humidity penetrating thereinto.

Once developer was coagulated in the developing device, developer is not supplied smoothly onto the photosensitive layer on which an electrostatic latent image is formed. This causes the density of the image developed to decrease and the image formed becomes blotchy.

Conventionally, it has been proposed to provide a manual switch for operating the developing motor provided for driving the developing device. When the manual switch was operated by the user after the exchange of the toner replenishing container, developer contained therein is stirred and agitated keeping the developing device itself in a non-operational mode in which for instance, only the developing motor is driven while the developing bias is turned off.

However, in that case mentioned above, key or switch operation becomes more and more confusing and, since said manual switch is operated only arbitrarily, there exists a high possibility that developer in the developing device not used so often is left unstirred for a long time to cause a coagulation thereof.

In such an image forming apparatus with a plurality of developing devices, there are provided a plurality of selecting keys for selecting or designating one of them desired and toner sensors each of which is provided for detecting when toner in the corresponding toner replenishing container was exhausted.

Consider a case where one of the toner containers is exchanged for a new one. In such a case, if another developing device is selected other than the developing device in which the toner container was just exchanged, the operator has to operate one of the selecting keys again although he wants to copy with toner contained in the toner container just exchanged.

Moreover, if he forgot the operation, a copy of the color which he did not expect is obtained undesirably.

SUMMARY OF THE INVENTION

An essential object of the present invention is to provide an image forming apparatus with a plurality of developing devices in which the image can be developed with developer in a fine state even when the developing device not being used frequently is designated for image forming.

Another object of the present invention is to provide an image forming apparatus in which the developing device is automatically selected into which developer such as toner has been replenished by, for instance, exchanging the developer container for a new one.

One other object of the present invention is to provide an image forming apparatus in which, when developer is replenished into one of the developing devices after all of them were exhausted, the developing device replenished is automatically selected irrespective of the selecting operation.

A further object of the present invention is to provide an image forming apparatus in which, when one of the developing devices is exchanged for a new one, said new one is automatically selected to form an image.

BRIEF DESCRIPTION OF THE DRAWINGS

These and other objects and features of the present invention will become apparent from the following description in conjunction with the preferred embodiments thereof with reference to the accompanying drawings in which.

DESCRIPTION OF THE PREFERRED EMBODIMENTS

Figure 1:
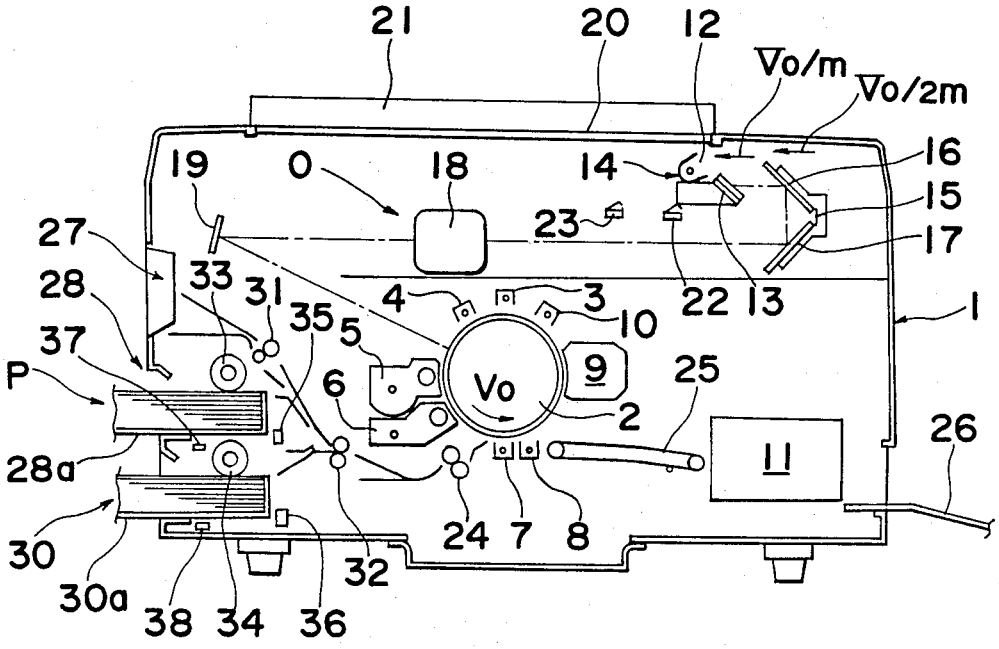
FIG. 1 is a schematic view of a copying machine according to the present invention.

In FIG. 1, the internal structure of a copying machine 1 is shown schematically. At the center of the machine 1, a photosensitive drum 2 is supported rotatably around the axis thereof and is driven by a main motor (not shown) in the anticlockwise direction as indicated by an arrow.

An electrifying charger 3, a sub eraser 4 for erasing portions before and after the image to be copied, first and second developing devices 5 and 6, a transferring charger 7, a separating charger 8, a cleaning device 9 and a main eraser 10 are arranged circumferentially around the photosensitive drum 2 spaced for each other.

As indicated by an arrow O, an optical assembly O for exposing an image of an original onto the photosensitive drum 2 is arranged in the upper portion of the machine and a paper feeding assembly P and a fixing device 11 are arranged at the side portions thereof opposite to each other.

As is well known to those skilled in the art, the optical assembly O is comprised of a scanning unit 14 providing a lamp means 12 for illuminating the original through a slit and a first movable mirror 13, a second and third movable mirror 16 and 17 being supported by a common mirror holder 15, a lens assembly 18 and a fixed mirror 19.

When the scanning unit 14 is started to move, the light reflected by the original is guided by the first, second and third movable mirrors 13, 16 and 17 and is exposed, through the lens assembly 18 and via the fixed mirror 19, onto the photosensitive drum 2 electrified by the charger 3 to form an electrostatic latent image of the image of the original thereon. The sub eraser 4 erases the charge of the area on the drum 2 not being corresponding to the image of the original.

Upon scanning, the scanning velocity V of the unit 14 is set equal to Vo/m wherein Vo is the circumferential rotational velocity of the drum 2 and m is a magnification designated for a copy and the second and third movable mirror 16 and 17 are moved with a velocity equal to one half of the scanning velocity of the unit 14. If the unit 14 was stopped at the correct starting position, a position sensor switch 22 is turned on to output a high level signal indicating that the unit 14 is positioned correctly with the first CPU (200). When the unit 14 is started and moved by a predetermined distance from the starting position, a timing switch 23 is turned on to generate a timing signal of high level in order to drive a timing roller 24 for feeding a copy paper.

Onto the surface of the drum 2, toner having a negative charge is applied by either one of the first and second developing devices 5 and 6 according to the choice by the user and the latent image is developed by toner to form a toner image thereof. Then, the toner image is transferred onto the copy paper (fed by the timing roller 24) by the transferring charger 7. The copy paper onto which the toner image has been transferred is separated from the surface of the drum by the separating charger 8. Then, the copy paper is transported to the fixing device 11 by a conveyer belt 25 and is discharged on a tray 26 after the toner image has been fixed by the fixing device 11.

Residual toner on the surface of the drum 2 is removed and collected by the cleaning device 9 and residual charge thereon is removed by the main eraser 10.

The copy paper feeding assembly P has a manual feeder 27, a first cassette feeder 28 and a second cassette feeder 30. When a copy paper is inserted into the manual feeder 27, it is transported to the timing roller 24 by a manual feed roller 31 and a common feed roller 32. A copy paper set in the cassette **28*a* or 30*a* of the cassette feeder 28 or 30 is transported to the timing roller 24 by a first or second feed roller 33 or 34 and the common feed roller 32**.

Each of rollers 24, 31, 32, 33 and 34 is connected, via a clutch means (not shown), to the driving system providing the main motor and, when the clutch means is switched on, the corresponding roller is driven by the main motor through the driving system. The first and second cassette feeders 28 and 30 provide size sensors 35 and 36, for detecting the size of a copy paper set in the cassette and empty sensors 37 and 38 for detecting respectively when the corresponding cassette becomes empty.

Figure 2:
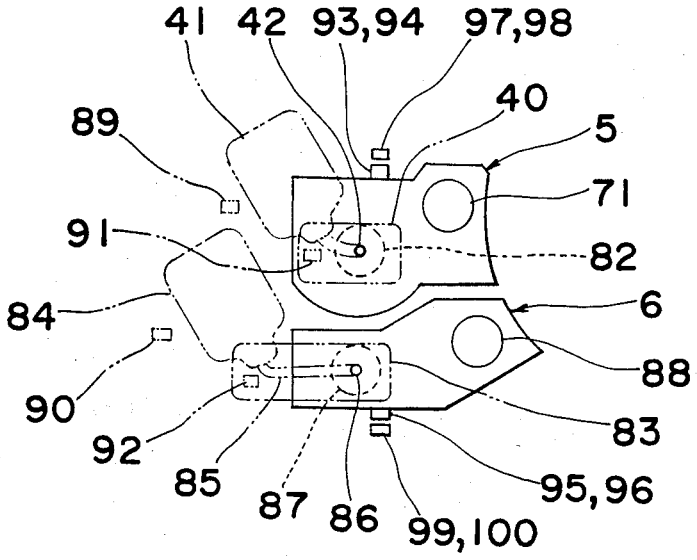
FIG. 2 is an enlarged partial side view showing the developing devices of the copying machine.
Figure 3:
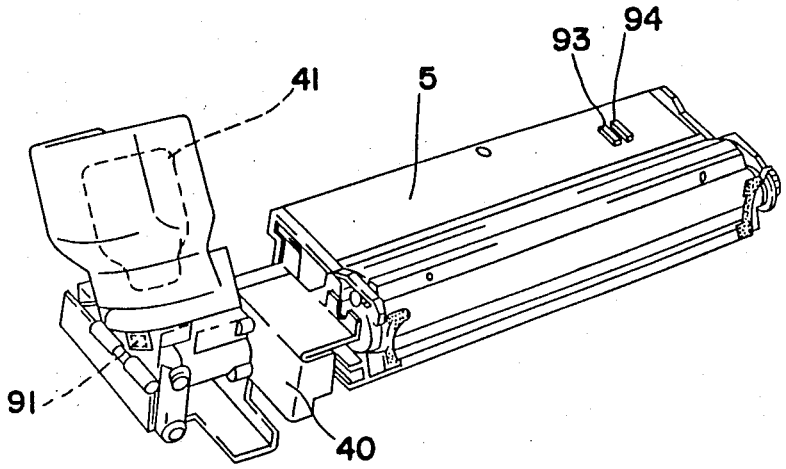
FIG. 3 is a perspective view of the first developing device shown in FIG. 2.
Figure 4:
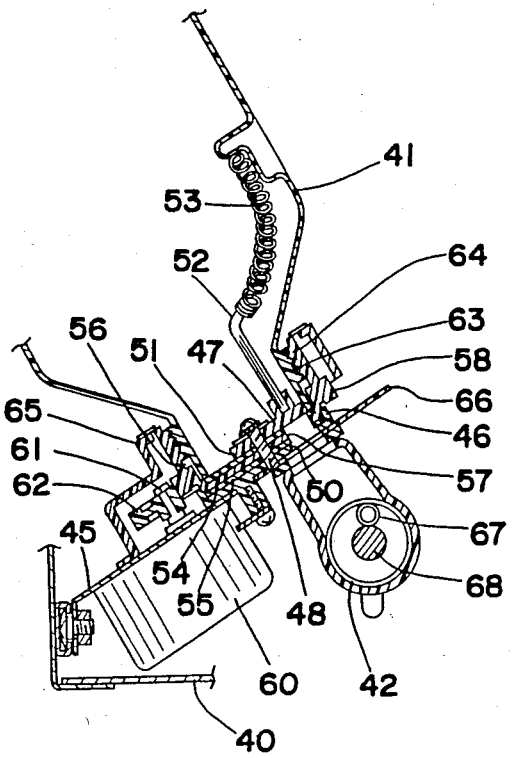
FIG. 4 is a sectional view of a part of the toner replenishing mechanism.

As shown in FIGS. 3 and 4, a bracket member 40 is mounted on the one end of the first developing device 5 in the longitudinal direction thereof and a toner replenishing bottle 41 is attached on the bracket 40 detachably. The toner in the bottle 41 is replenished into the first developing device 5 through a transporting tube 42 (see FIG. 2) extending in the longitudinal direction thereof.

Figure 5:
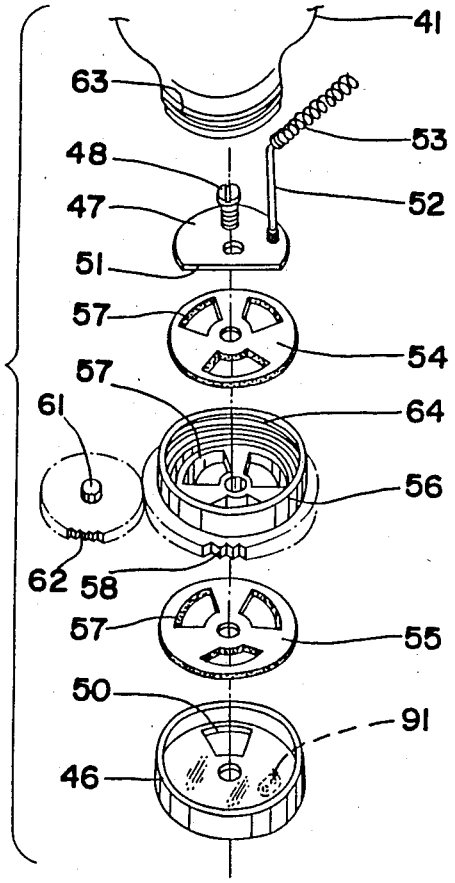
FIG. 5 is a perspective view showing individual pieces constituting the toner replenishing mechanism.

There is shown a mechanism for replenishing toner into the first developing device 5 in FIGS. 4 and 5.

As shown in FIGS. 4 and 5, a base plate 45 is fixed inclined to the bracket 40 and a ring holder 46 is fixed on the upper surface of the base plate 45. Above the ring holder 46, a circular cutting plate 47 having a cut-off portion 51 is fixed thereto by a bolt means 48 coaxially. A fan-shaped toner replenishing aperture 50 is provided on the ring holder 46. The toner replenishing aperture 50 and the cut-off portion 51 of the cutting plate 47 are so arranged as to position opposite to each other with respect to the center bolt 48. Further, at an off set position of the cutting plate 47, a stirring rod 52 is erected so as to extend in the first toner replenishing bottle 41 and, a coil spring means 53 for stirring toner in the bottle is fixed to the upper end of the stirring rod 52 at the lower end thereof. As shown in FIG. 4 clearly, the coil spring means 53 is so inclined as to contact to the inner surface of the bottle 41 when inserted therein.

Between the ring holder 46 and the cutting plate 47, there is provided a bottle holding ring 56 rotatable relative to the ring holder 46 and the cutting plate 47. The circular plate of the bottle holding ring 56 has three fan-shaped apertures 57 formed at a predetermined angle with respect to the center thereof. Two circular sheets 54 and 55 each having three apertures 57 similar to those of the bottle holding ring 57 are adhered respectively to the upper and lower surfaces of the circular plate thereof. Said bottle holding ring 56 has a driven gear 58 formed coaxially around the outer periphery thereof. The driven gear 58 is engaged with a drive gear 62 mounted on a drive shaft 61 of a first replenishing motor 60 which is mounted on the lower surface of the base plate 45. Therefore, when the first replenishing motor 60 is started to rotate, the bottle holding ring 56 is rotated around the axis thereof. The toner replenishing bottle 41 is detachably mounted to the bottle holding ring 56 by engaging a male screw 63 formed around the outer periphery of the mouth of the bottle with a female screw 64 formed around the inner periphery of the cylindrical wall portion of the bottle holding ring 56. This bottle holding ring 56 is covered with a cover 65 which holds the upper end of the former so as not to come out in the axial direction.

When the first toner replenishing bottle 41 is rotated, toner in the bottle is dropped into the aperture 57 of the bottle holding ring 56 through the cut-off 51 of the cutting plate 47. Excess toner is cut by the cutting plate 47 according to the rotation of the bottle holding ring 56 to supply a predetermined amount of toner in the aperture 57. Said toner of the predetermined amount is dropped into the end portion of the transporting tube 42 through the toner replenishing aperture 50 of the ring holder 46 during a further rotation of the bottle holding ring 56. Thus, toner of an amount proportional to the number of rotation of the first toner bottle 41 is supplied from the first toner replenishing bottle 41 into the transporting tube 42. Further, when the toner bottle 41 is rotated, toner therein is stirred by the stirring rod 52 and the coil spring means 53 to maintain the fluidity of toner in a good state. The supply of toner is stopped when a slide shutter 66 is operated to close the toner replenishing aperture 50.

Figure 6:
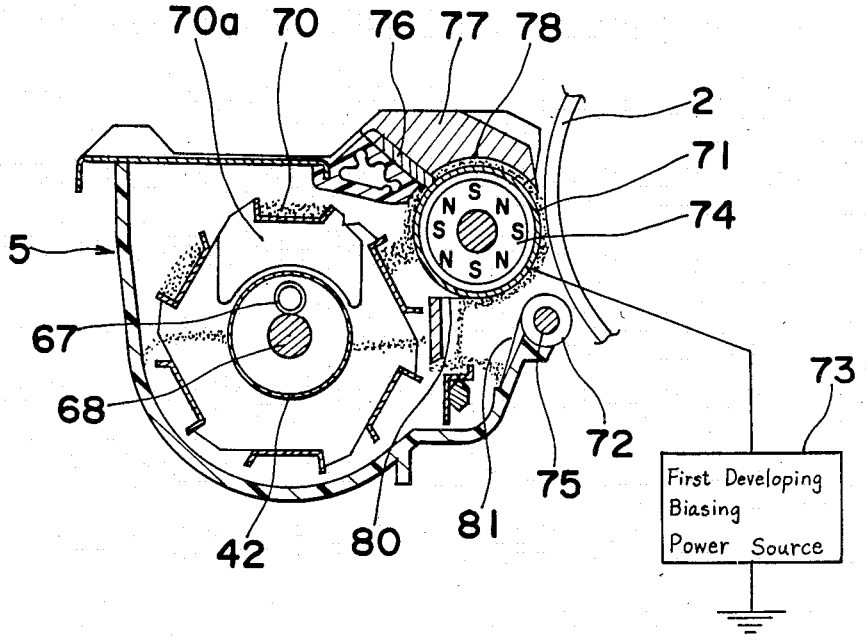
FIG. 6 is a sectional view of the first developing device.

FIG. 6 shows a sectional view of the first developing device 5.

Referring now to FIG. 6, there is provided a transporting spring 67 in the transporting tube 42 which is wound spirally around a transporting shaft 68 provided coaxially in the tube 42. Toner supplied in the tube is transported into the developing device according to the rotation of the transporting shaft 68 and the transporting spring 67.

In the first developing device 5, there are provided a bucket roller 70 having a stirring blade 70*a* therein, a developing sleeve 71 and a collecting sleeve 72 which are arranged parallel to each other. While the bucket roller 70 and developing sleeve 71 are driven to rotate around their own axes clockwise respectively, the collecting sleeve 72 is driven to rotate anticlockwise. To the developing sleeve 71, a bias voltage (herein-after referred to as the first developing bias) is applied which is supplied by a biasing power source 73. In the developing sleeve 71 and collecting sleeve 72, magnet rollers 74 and 75 are inserted respectively. The magnet roller 74 is so driven as to rotate anticlockwise contrary to the developing sleeve 71 and the magnetic roller 75 is driven synchronously with the rotation of the magnet roller 74 in the clockwise direction contrary to the collecting sleeve 72.

The toner transported in the first developing device 5 is stirred and mixed with magnetic carrier charged thereinto according to the rotation of the bucket roller 70 and is electrified to have a negative polarity due to rubbing contact therewith. The developer being a mixture of toner and magnetic carrier, when the first developing bias is applied to the developing sleeve 71, is supplied onto the surface of the photosensitive drum 2 through a passage 78 defined between the developing sleeve 71 and a cover block 77. The amount of developer to be supplied onto the drum 2 is restricted by a flow restricting plate 76 arranged at the entrance of the passage 78. Toner in the developer is adhered to the surface of the drum 2 to develop the electrostatic latent image thereof. Excess toner in the developer supplied to the drum is conveyed by the developing sleeve 71 into the developing device and is scraped from the surface of the sleeve 71 by a scraper blade.

The magnetic carrier adhered to the surface of the drum is collected into the device 5 according to the rotations of the collecting sleeve 72 and magnet roller 75 and is scraped from the surface of the collecting sleeve 72 by a scraper blade 82 to return to the bucket roller 70.

Contrary to the above, if the first developing bias was not applied to the developing sleeve 71, the electrostatic latent image is not developed even when the bucket roller 70 and developing sleeve 71 are driven.

As indicated by a dotted line in FIG. 2, there is provided a motor 82 (hereinafter referred to the first developing motor) for driving the transporting shaft 68, bucket roller 70, developing sleeve 71, collecting sleeve 72 and magnet roller 74 in the first developing device which is mounted on the other end thereof opposite to the bracket 40.

The second developing device 6 is schematically shown in FIG. 2. On one end thereof, there is mounted a relatively wide bracket 83 and, on the one end of the bracket 83 in the direction of the width thereof, a second toner replenishing bottle 84 is attached detachably which is driven to rotate by a second replenishing motor (not shown). Toner in the second bottle 84 is supplied into the second developing device 6 through a transporting tube 85 extending in the direction of the width of the bracket 83 and a transporting tube 86 connected to the other end of the tube 85 orthogonally thereto.

The second developing device 6 has an internal structure substantially the same as that of the first developing device 5 although the outer configuration thereof is different from that of the latter. Namely, the second developing device 6 provides a bucket roller (not shown) being driven by a second developing motor 87, a developing sleeve 88 and a collecting sleeve (not shown) etc. And, when a biasing voltage (hereinafter referred to the second developing bias) is applied to the second developing sleeve 88 by a second developing bias power source, developer is applied onto the surface of the drum 2 by the developing sleeve 88 to develop the electrostatic latent image of the drum by the second developing device 6.

As mentioned above, since other internal structure of the second developing device is substantially the same as that of the first developing device, further explanation thereof is abbreviated in order to avoid repetition.

As indicated by small boxes 89 and 90 in FIG. 2, there are provided first and second bottle sensors 89 and 90 near the first and second toner replenishing bottles 41 and 84 respectively to detect if each bottle was attached or not. Each bottle sensor 89 or 90 outputs a high level signal when the corresponding bottle is attached. Further, in order to detect whether there is toner in the corresponding replenishing bottle or not, there are provided two toner sensor 91 and 92 near each mouth of the corresponding bottle. Each toner sensor 91 or 92 is so set as to output a high level signal when toner remains in the corresponding bottle.

Moreover, in order to identify the color of toner in the toner replenishing bottle, there may be provided one or two small magnets 93, 94; 95, 96 on each upper surface of the first device 5 and the lower surface of the second device 6. And, in order to detect if these small magnets were attached actually or not at each predetermined position, there are provided in the body of the machine four lead switches 97, 98, 99 and 100 each of which is arranged corresponding to the position where each small magnet is to be attached.

Each color of toner used respectively in the first and second developing devices 5 and 6 is identified according to a combination of ON, OFF signals output from the lead switches 97 to 100. In the next table, there is shown an example of the method for identifying the color of toner.

TABLE

| Switch 99 or 97 | Switch 98 or 100 | Color of Toner |
|---|---|---|
| ON | ON | Black |
| ON | OFF | Red |
| OFF | ON | Yellow |
| OFF | OFF | Blue |

As far as the present specifications are concerned, the term "developing device" includes the toner replenishing bottle to be attached thereto.

Figure 7:
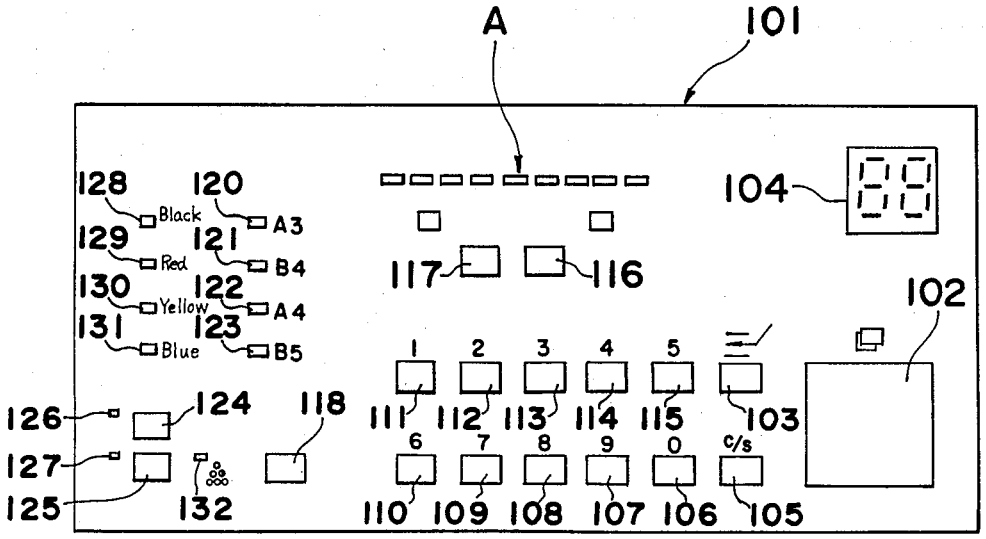
FIG. 7 is a schematic plan view of an operation panel provided for the copying machine.

As is shown in FIG. 7, there is provided an operation panel 101 on the upper surface of the body of the copying machine.

On the operation panel 101, there are provided; a print key 102 for commanding the start of copying, an interrupting copy key 103, a clear/stop key 105 for suspending copying just after the start thereof or on the way of multi-copy and clear the number of copies set at a display 104 for displaying the same to reset to "1" of the standard copy mode, which is comprised of a plurality of LEDs, ten keys 106 to 115 for setting the number of copy, an up-key 116 and down-key 117 for increasing and decreasing the amount of exposure by changing the voltage to be applied to the lamp, a group of LEDs A for indicating step-like the amount of exposure chosen by turning on one of them corresponding thereto, a selecting key 118 for selecting either one of the first and second feeding cassette means 28 and 30, a plurality of LEDs 120, 121, 122 and 123 for indicating the size of copy paper set in the cassette selected, first and second selecting keys 124 and 125 for selecting the first and second developing devices 5 and 6 respectively, two LEDs 126 and 127 for indicating the developing device selected, a plurality of LEDs 128, 129, 130 and 131 for indicating the color of toner in the toner replenishing bottle selected and a warning LED 132 for indicating the bottle is empty when the bottle of the developing device became exhausted.

Figure 8:
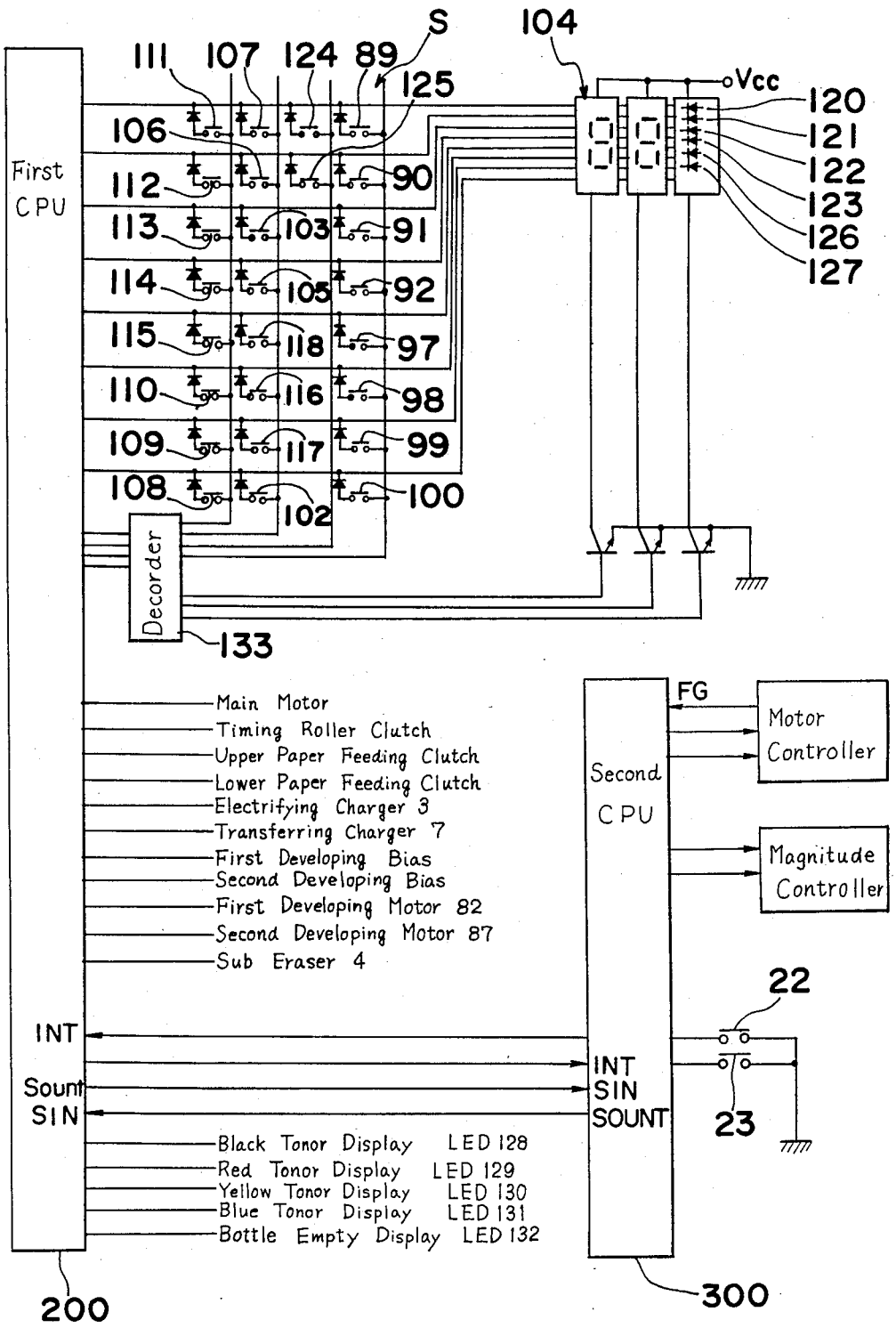
FIG. 8 is a block diagram of the control circuit of the copying machine.

FIG. 8 shows a control circuit provided in the copying machine.

Referring to FIG. 8, the control circuit provides first and second CPUs (Center Processing Unit) 200 and 300. To the first CPU 200, there is connected a switch-matrix S having a construction in which all of the keys provided on the operation panel 101, the first and second bottle sensors 89 and 90, the first and second toner sensors 91 and 92, lead switches 97 to 100 for identifying the color of toner and so on are arranged and connected to form a matrix. The first CPU 200 controls the main motor, individual roller clutch etc. according to key operations and/or sensor signals and further controls turning on and/or off the LED's display for indicating the number of copies and individual LED through a decoder 133.

Contrary to the above, the second CPU 300 is provided for controlling mainly the optical system O, to which the position switch 22 and timing switch 23 etc. are connected. The first and second CPUs 200 and 300 are connected with each other in order to operate them synchronously.

Hereinafter, the flows of programs to be processed by the first and second CPUs will be explained.

Figure 9:
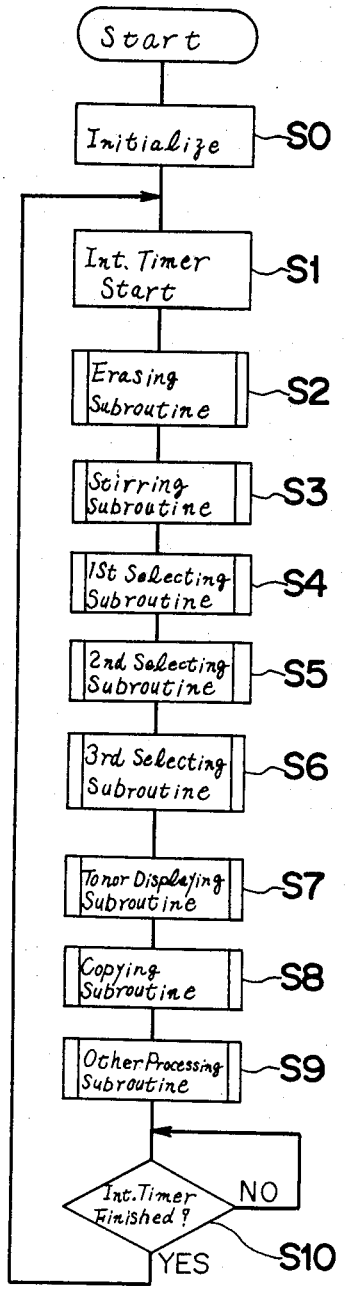
FIG. 9 is a flow chart of the main routine to be executed by the CPU provided for controlling the copying machine.

FIG. 9 shows a flow chart of a main routine program.

(i) When the power switch is turned on to start the main routine, the first and second CPUs are initialized and each device is initialized to the initial mode at step S0.

(ii) At step S1, the internal timer initialized is started. Said internal timer determines the time interval of one routine irrespective to processings in each of subroutines (mentioned below). Each timer provided in each subroutine is set using said time interval as a unit.

(iii) At step S2, the subroutine for erasing (mentioned below) is called and executed. Charge remaining on the photosensitive drum 2 is removed according to this subroutine just after the power is applied.

(iv) At step S3, the subroutine for agitating or stirring developer is called and executed. According to this subroutine, developers in the first and second developing devices 5 and 6 are stirred or agitated just after the power switch is turned on.

(v) At step S4, the 1st subroutine for selecting the developing device is called. According to this subroutine, of one of the developing devices is detached from the copying machine, the other developing device is automatically selected as far as it is still attached thereto and, if one of the developing devices is attached thereto, said one developing device is automatically selected.

(vi) At next step S5, the 2nd subroutine for selecting the developing device is called. According to this subroutine, in the case where the copying operation becomes impossible due to the reason that all of the toner in both first and second toner replenishing bottles 41 and 84 are exhausted, the developing device in which the bottle was exchanged to a new one is automatically selected irrespective of the selection of the developing device.

(vii) At step S6, the 3rd subroutine for selecting the developing device is called. According to this subroutine, when either one of the toner bottles is detached from either one of the developing devices for replenishing toner, the other developing device is automatically selected as long as the toner bottle is attached thereto and, when the toner bottle having been detached was attached after filling toner therein, the developing device into which the new toner bottle was attached is automatically selected.

(viii) At step S7, the subroutine for indicating the color of toner in the toner bottle selected and whether toner is in the toner bottle selected and whether toner remains therein or not is called and executed to turn on one of color indicating LEDs 128 to 131 and to turn on or off the LED 132 for indicating whether toner is in the bottle or not.

(ix) At step S8, the subroutine for executing copy is called and executed. According to this subroutine, one copy operation is performed if it was commanded by the print key 102.

(x) At step S9, other subroutines for executing other necessary controls, for example, thermal control of the fixing device 11 are called and executed. Since these subroutines are well known to those skilled in the art and are not the subject of the present invention, further explanation about them are abbreviated.

(xi) At step S10, it is decided whether the internal timer was counted up or not and the process is returned to step S1 when said timer has been counted up.

Herebelow, individual subroutines mentioned above will be stated.

*Subroutine for Erasing

Figure 10:
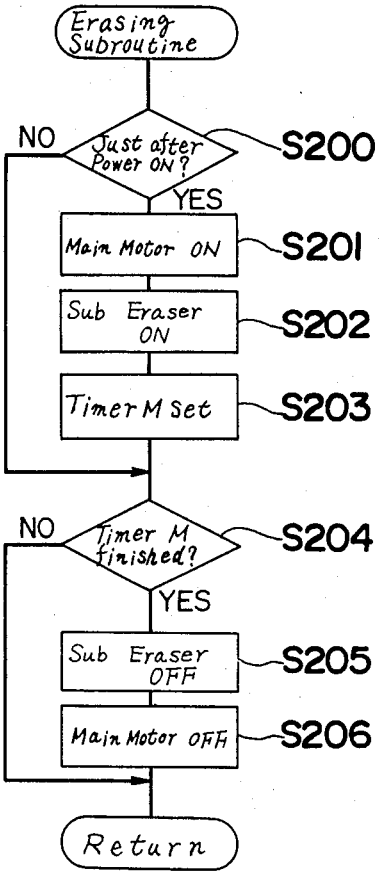
FIG. 10 is a flow chart of the subroutine for erasing.

FIG. 10 shows the flow chart thereof.

(i) It is decided at step S100 whether the power switch was turned on just before the present time or not. If it was just after the power switch was turned on, the main motor, main eraser 10 and sub eraser 4 are turned on respectively at steps S101 and S102 to start erasing the photosensitive drum 2 or removing charge remained on the surface thereof. The timer M for counting the time of the erasing is set at step S103. If it was not just after the power switch was turned on, the process proceeds to step S104 skipping steps S101 to S103.

(ii) At step S104, it is decided whether the timer M was counted up or not. If it was counted up, the sub eraser 4, main motor and main eraser 10 are sequentially turned off at steps S105 and S107 to complete the erasing and the process is returned to the main routine. If it was not counted up, the process is returned to the main routine skipping steps S105 and S106.

*Subroutine for Stirring Developer

Figure 11:
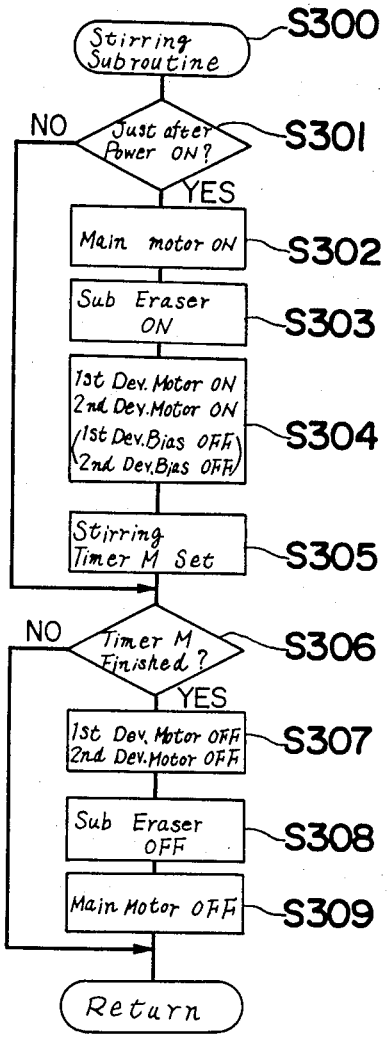
FIG. 11 is a flow chart of the subroutine for stirring toner, FIGS. 12(A) and (B) is a flow chart of the 1st subroutine for selecting the developing device.

FIG. 11 shows a flow chart of the subroutine S3 for stirring developer.

(i) At step S301, it is decided whether the time counted from the timing at which the power switch was turned on was within predetermined time or not.

If it was within the predetermined time interval, the main motor and sub eraser 4 are turned on at steps S302 and S303. At step S304, the first and second developing motors 41 and 91 are turned on and the first and second developing bias power sources are turned off. The timer M for stirring is set at step S305.

When the timer is ON, developers in the first and second developing devices 5 and 6 are stirred by the bucket rollers etc. respectively. It is to be noted that toner is not adhered to the surface of the drum, even though the developing motors are driven since the first and second bias power sources are turned off.

(ii) At step S306, it is decided whether the timer M was counted up or not and, if it was not, the process is returned directly to the main routine skipping steps S307, S308 and S309.

When the timer M is counted up, the first and second developing motors 41 and 91, sub eraser 4 and main motor are turned off to return to the main routine.

Contrary to the above, if it was decided at step S301 that is was not just after the power switch was turned on, the process proceeds directly to the step S306 skipping steps S302 to S305 and, then, returned from the step S306 to the main routine. Therefore, the stirring operation mentioned above is not performed in this case.

*1st Subroutine for Selecting the Developing Device

FIGS. 12(A) and (B) show a flow chart of this 1st subroutine for selecting the developing device.

(i) At step S400, it is decided whether both lead switches 97 and 98 provided for the first developing device 5 were changed from ON to OFF respectively or not, in other words, whether the first developing device 5 was detached from the copying machine 1 or not. If it was detached, the process proceeds to step S401 to decide whether the first indicating LED 126 for the first developing device was turned on or not, namely, the first developing device 5 was selected or not.

(ii) If LED 126 was ON at step S401, in other words, if the first developing device was selected when it was detached from the machine, it is decided at S402 whether both of the lead switches 99 and 100 provided for the second developing device 6 were not OFF.

If both of them were not OFF, in other words, if the second developing device 6 was mounted at the position therefor in the machine 1, the selection is automatically changed from the first developing device 5 to the second one irrespective of the operation of the second selecting key 125. Then, at step S403, the first indicating LED 126 for the first developing device is turned off and the second indicating LED 127 is turned on to indicate that. At step S404, the subroutine for displaying the color of toner is called to display the color of toner in the second developing device 6.

If the first LED 126 was OFF, namely, the second developing device 6 had been selected before the first device was detached, the process proceeds to step S410 skipping steps S402 and S404 since it is not necessary to change the selection.

If both of the two lead switches 99 and 100 were OFF, namely, if the second developing device 6 was not attached to the copying machine when the first device was detached therefrom, the process proceeds to step S410 skipping steps S403 and S404 since it is unnecessary to change the selection.

(iii) If the first developing device 5 was not detached at step S400, the process proceeds to step S405 to decide whether the second device 6 was detached therefrom or not. If the second device 6 was detached, the selection of the developing device is automatically changed from the second one to the first one irrespective to the operation of the first selecting key 124 provided that the second one is selected at that time and that the first one is attached thereto (steps S406 and S407). Then, it is displayed by turning on the first LED 126 at step S408. Further, the color of toner in the first one is displayed at step S409.

(iv) It is decided at the next step S410, whether two lead switches 97 and 98 were both changed from OFF to another state or not, in other words, whether the first one is attached thereto or not. If the first developing device 5 was attached thereto, it is automatically selected irrespective to the operation of the first selecting key 124. Accordingly, the first indicating LED is turned on to indicate that the first one is selected at step S411 and, at step S412, the color of toner in the first one is displayed.

Moreover, at step S413, the first replenishing motor 60 is turned on to rotate the first toner bottle 41. According to the rotation of the first toner bottle 41 together with the rotation of the transporting shaft 68 being driven by the first developing motor 82 which was already started to drive when the first developing device 5 was selected, toner in the first toner bottle 41 begins to feed from the bottle into the developing device. At the same time, the wait Flag is set to "1" to prohibit a copying operation until the toner fed is mixed sufficiently with carrier in the first developing device and the timer N1 for counting the prohibition time is started.

When the timer N1 is counted up at S414, the first replenishing motor 60 is turned off to finish supplying toner needed when the first developing device is set and the wait Flag is reset to "0" to cancel the prohibition of copying operation.

(v) If the first developing device 5 was not set at step S410, the process is proceeded to step S416 to decide whether the lead switches 99 and 100 were both changed from OFF to another state, in other words, the second developing device 6 was attached thereto. If it was attached, it is automatically selected and, at steps S417 and S418, the selection and the color of toner therein are displayed respectively. Then, at step S419, the second replenishing motor is turned on to supply toner in the toner bottle 84 to the second developing device 6. In this case, since the total length of the transporting tubes 85 and 86 of the second device 6 is longer than that of the transporting tube of the first device 5, the timer N2 for counting the driving time of the second replenishing motor is set so as to have a time longer than that of the timer N1.

*2nd Subroutine for Selecting the Developing Device

Figure 13:
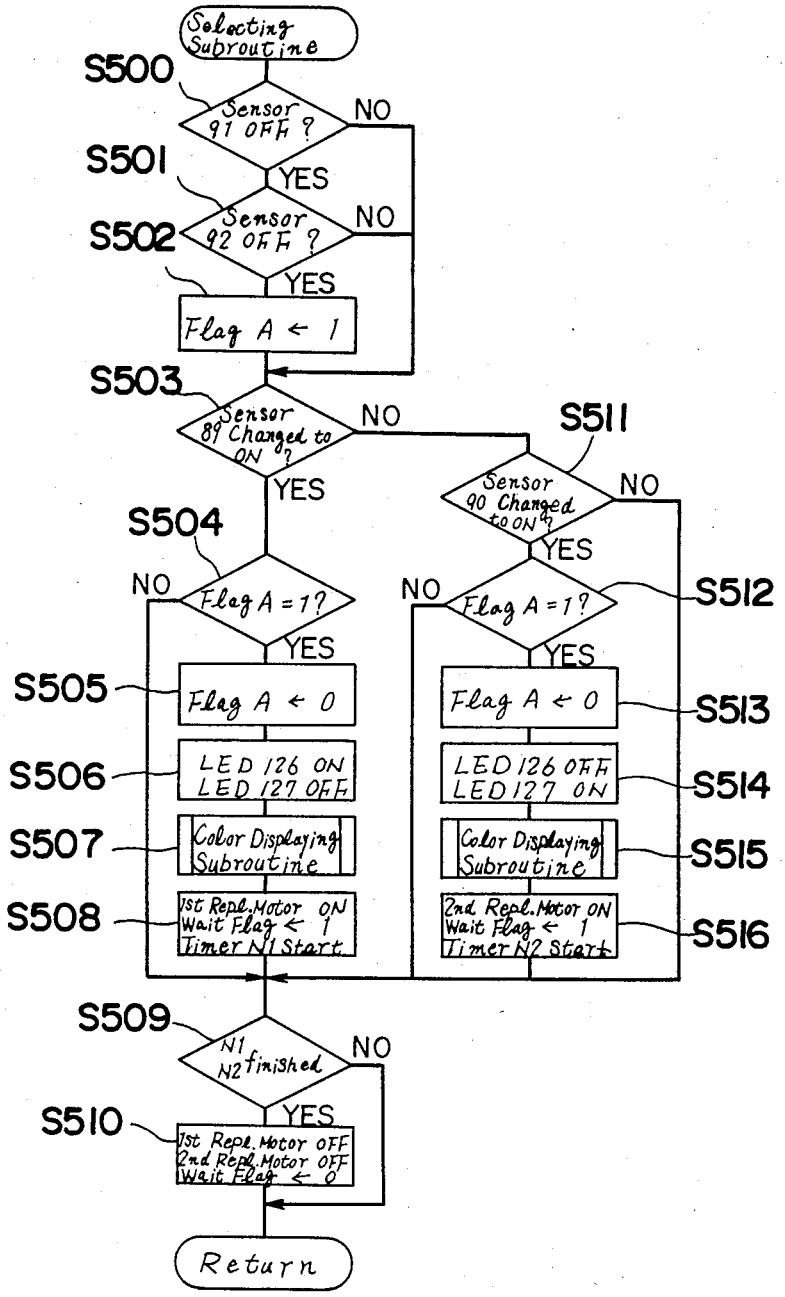
FIG. 13 is a flow chart of the 2nd subroutine for selecting the developing device, FIGS. 14(A) and (B) show a flow chart of the 3rd subroutine for selecting the developing device, FIGS. 15(A) and (B) show a flow chart of the subroutine for displaying toner data, FIGS. 16(A) and (B) show a flow chart of the subroutine for displaying the color of toner selected, and FIGS. 17(A), (B), (C), (D) and (E) show a flow chart of the subroutine for the copying operation.

FIG. 13 shows a flow chart of the subroutine S5 of FIG. 9.

(i) At steps S500 and S501, it is decided respectively whether the first and second toner sensors 91 and 92 are OFF or not. If both of the first and second sensors were OFF, namely, both toner in the first and second toner replenishing bottles 41 and 84 had been exhausted, the process is proceeded to step S502 to set a Flag A to "1". Said Flag A designates, when set to "1", the mode for selecting the developing device automatically when the toner bottle was exchanged to a new one.

If it was decided that at least one of the sensors 91 and 92 was ON, namely, toner in at least one of the toner bottles 41 and 84 was not exhausted, the process proceeds to step S503 skipping S502 to maintain the Flag A unchanged (Flag A=0).

(ii) At step S503, it is decided whether the first bottle sensor 89 is changed from OFF to ON or not. If the sensor 89 was changed to ON, it is decided at step S504 whether the Flag A is "1" or not since it is presumed that the first toner bottle 41 was exchanged for new one.

If Flag A was equal to "1" at step S504, it is presumed impossible for the second developing device 6 to receive any further toner when it was confirmed that the new bottle 41 was attatched to the first developing device 5. Namely, the first developing device 5 is automatically selected irrespective to the operation of the first selecting key 124. When the first developing device is selected, the first developing motor 82 is started to stir toner therein. At step S505, the Flag A is reset to "0" and, at step S506, the first LED 126 is turned on and the second LED 127 is turned off to indicate that the first developing device 5 is selected. At step S507, the subroutine for displaying the color of toner is called to indicate the color of toner in the first developing device 5. At next step S508, the first toner replenishing motor 60 is started to supply toner from the toner bottle 41 into the first developing device 5 in cooperation with the transporting shaft 68 which is driven by the first developing motor 82. At the same step, a wait Flag is set to "1" in order to prohibit copying for a short time necessary for mixing toner supplied with carriers sufficiently and a timer N1 for counting said short prohibition time is started.

(iii) At step S509, it is decided whether the timer N1 was counted up or not. When the timer N1 was counted up, the process proceeds to step S510 to turn off the first replenishing motor 60 in order to complete a toner supply at the exchange of the toner bottle. And, the wait Flag is reset to "0" and the process is returned to the main routine.

(iv) If the Flag A was equal to "0" at step S504, it is presumed that the toner bottle 84 still containing toner therein is mounted on the second developing device 6 at the timing when the toner bottle 41 is exchanged for a new one in the first developing device 5. Therefore, in this case, the automatic selection of the first developing device 5 is not done and the process proceeds to step S509 skipping steps S505 to S508.

(v) If it was decided at step S503 that the first toner bottle 41 was not exchanged since the first toner bottle sensor 89 was not changed from OFF to ON, the process proceeds to S511 to decide due to the signal of the second bottle sensor 90 whether the second toner bottle 84 was exchanged to a new one or not.

(vi) At step S511, if it was decided that the second toner bottle 84 was exchanged for new one, the Flag A is set to "1".

In this case, the second developing device 6 is automatically selected, since it is reasonably presumed that the first one 5 cannot receive further toner at the time that the second toner bottle 84 is exchanged.

Therefore, through steps S513 to S516, S509 and S510, proceedings are similar to those in the case that the first developing device 5 is automatically selected.

However, the timer N2 for prohibiting copying operation is set longer than the timer N1 since the total length of the transporting tubes 85 and 86 is longer than the length of the transporting tube 42 of the first developing device 5.

According to the subroutine just mentioned above, if the first and second toner bottles became exhausted, and only one toner bottle was exchanged, the developing device corresponding to the bottle exchanged is automatically selected. When both toner bottles are exchanged successively, the toner bottle corresponding to the bottle exchanged prior to the other is automatically selected.

However, if both bottles were exchanged successively, the subroutine may be altered so as to prohibit the automatic selection of the developing device.

*3rd Subroutine for Selecting the Developing Device

FIGS. 14(A) and (B) show a flow chart therefor.

(i) At step S600, it is decided whether the first bottle sensor 89 was changed from ON to OFF, namely, the first toner replenishing bottle 41 was detached from the first developing device 5. If it was detached, the process proceeds to step S601 to decide whether the first indicating LED 126 for the first developing device is ON or not. If the LED 126 was ON, in other words, the first developing device 5 was selected at the time that the first toner bottle 41 was detached in order for the exchange thereof, the process proceeds to step S602 to decide whether the second toner bottle 90 is ON or not, namely, the second bottle 84 is attached into the second developing device 6.

(ii) If the second toner replenishing bottle 84 was being attached when the first one 41 was detached from the first developing device 5, the second developing device 6 is automatically selected irrespective to the operation of the second selecting key 125 presuming that it is possible to develop by the second developing device 6. Accordingly, at step S603, the second indicating LED 127 is turned on to display that the second one is selected while the first indicating LED 126 is turned off and, at step S604, the subroutine for displaying the color of toner therein is called to display it.

If the first indicating LED 126 was OFF at step S601, in other words, the first developing device 5 was not selected at the time that the first toner bottle was detached, the process proceeds to step S610 skipping steps S602 to S604, since it is not necessary to change the selection of the developing device.

At step S602, if the second bottle sensor 90 was OFF, in other words, the second toner bottle 84 had been already detached before the first toner bottle 41 was detached although the first developing device 5 was selected, the process proceeds also to step S610 skipping steps S603 and S604.

(iii) At step S600, if the first bottle sensor 89 was not changed to OFF, namely, the first toner bottle 41 was not detached, the process proceeds to step S605 to decide whether the second bottle sensor 90 was changed to OFF, namely, the second toner bottle 94 was detached from the second developing device 6.

If it was detached, the proceedings similar to those in the case that the first toner bottle was detached are executed. Namely, the first developing device 5 is automatically selected when the second toner bottle 84 was detached under the conditions that the second toner bottle was selected and that the first toner bottle 41 was being attached. Also, the result of the selection and the color of toner are displayed.

(iv) At step S610, it is decided whether the first bottle sensor 89 was changed to ON or not, namely, the first toner bottle 41 was attached to the first developing device 5. If it was attached, the first developing device 5 is automatically selected irrespective to the operation of the first selecting key 124. If it was selected from the first, the selection is unchanged. At step S611, the first indicating LED 126 is turned on while the second indicating LED 127 is turned off to indicate that the first one is selected.

Then, the subroutine for displaying the color of toner is called and executed at step S612. At step S613, the first replenishing motor 60 is started to drive and toner in the first toner bottle is begun to feed into the first developing device under the cooperation of the first replenishing motor with the transporting shaft 68 which is driven by the first replenishing motor started to drive when the first selecting key was operated. At the same time, the wait Flag is set to "1" and the timer N1 for counting the prohibition time is started.

(v) At step S614, it is decided whether the timer N1 was counted up or not. When the timer N1 was counted up, the process proceeds to step S615 to turn off the first replenishing motor 60 in order to cease the supply of toner and the wait Flag is reset to "0" to return the main routine.

(vi) If the first bottle sensor 89 was not changed to ON, the process proceeds to decide whether the second bottle sensor 90 was changed from OFF to ON, namely, the second toner bottle 84 was attached to the second developing device 6 or not.

When the second toner bottle 84 was attached, the second developing device 6 is automatically selected and, through steps S617 to S619, S614 and S615, the selection thereof and the color of toner are displayed similar to the case where the first device was selected and toner is supplied from the second toner bottle 84 to the second developing device.

It is to be noted, however, the timer N2 for counting the prohibition time is set so as to to have a time longer than of the timer N1 since that the total length of the transporting tubes 85 and 86 are longer than that of the transporting tube 42 of the first developing device.

*Subroutine for Displaying Toner Data

Figure 15A:
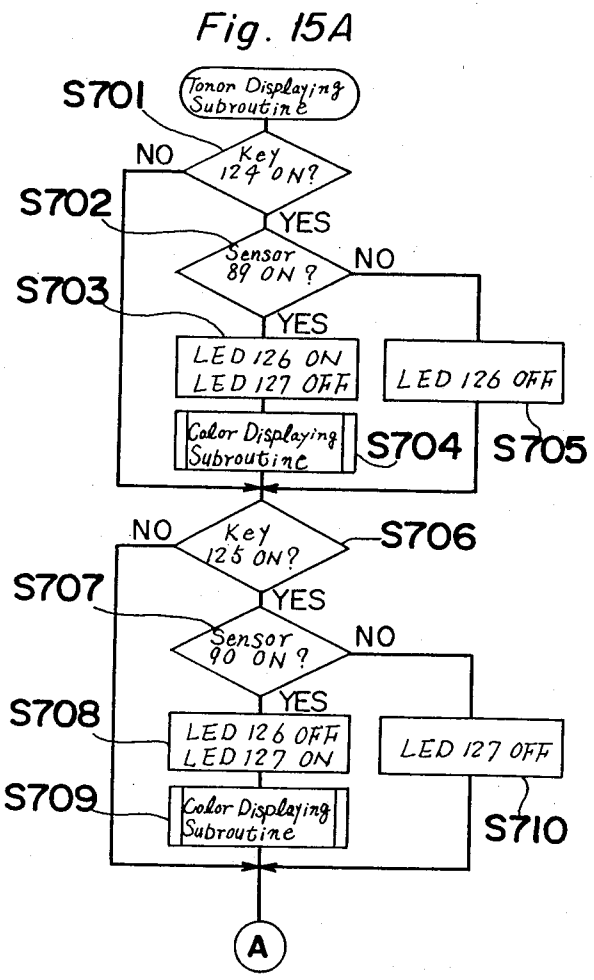
Figure 15B:
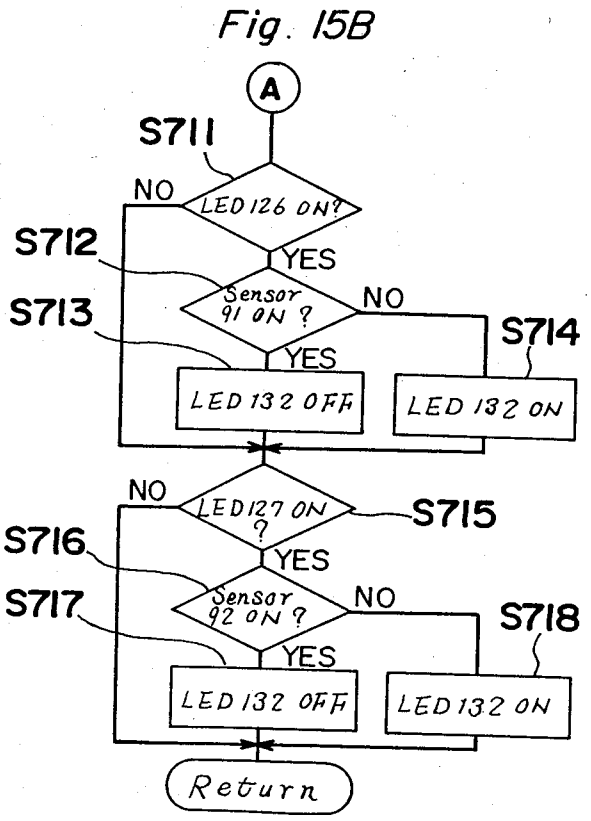

FIGS. 15(A) and (B) show the subroutine for displaying toner data.

(i) At step S701, it is decided whether the first selecting key 124 for the first developing device was operated or not. If operated, the process proceeds to step S702 to decide whether the first toner bottle 41 is attached to due to the signal of the first bottle sensor 89.

(ii) If the first toner replenishing bottle 41 was attached to, the first developing device 5 is selected and the first indicating LED 126 for the first developing device 5 is turned on and the second indicating LED 127 is turned off at step S703. Further, the subroutine for displaying the color of toner is called at step S704 to indicate the color of toner in the first developing device 5 by turning on one of LEDs 128 to 131.

If the toner bottle was not attached, the first indicating LED 126 for the first developing device 5 is turned off since it is impossible to select the first device 5 and the process proceeds to step S706.

If the print key 102 was not operated, the process proceeds to step S706 skipping steps S702 to S705 since the first developing device 5 is not selected.

(iv) At step S706, it is decided whether the second selecting key 125 for the second developing device 6 was operated or not. If operated, the second developing device 6 is selected provided that the second toner bottle is attached thereto and, through steps S707 to S710, each of LEDs is turned on or off similar to the case where the first selecting key 124 was operated.

If the second selecting key 125 was not operated, the process proceeds directly to step S711 skipping steps from S707 to S710.

(v) At step S711, it is decided whether the first displaying LED 126 for the first developing device was turned on or off. If said LED was turned on, namely, the first developing device 5 was selected, the process proceeds to decide whether toner remains in the first toner bottle 41 according to the signal from the first toner sensor 91.

(vi) If the first toner sensor 91 was ON, namely, toner remains in the first toner bottle 41, the process proceeds to step S713 to hold the toner indicating LED 132 is in the OFF state thereof.

If toner was not in the bottle 41, the process proceeds to step S714 to turn on the toner indicating LED 132 in order to indicate that the bottle should be exchanged for a new one.

If the LED 126 was OFF, the process proceeds to step S715 skipping steps from S712 to S714.

(vii) At step S715, it is decided whether the second displaying LED 127 for the second developing device was turned on or not. If the LED 127 was ON, namely, the second developing device 6 was selected at steps S716 to S718, it is decided whether toner remains in the second toner bottle 84 or not and the result thereof is displayed similarly to the case that the first developing device 5 was selected.

If the second displaying LED 127 was not turned on, namely, the second developing device was not selected, the process is returned to the main routine skipping steps from S716 to S718.

*Subroutine for Displaying the Color of Toner

Figure 16A:
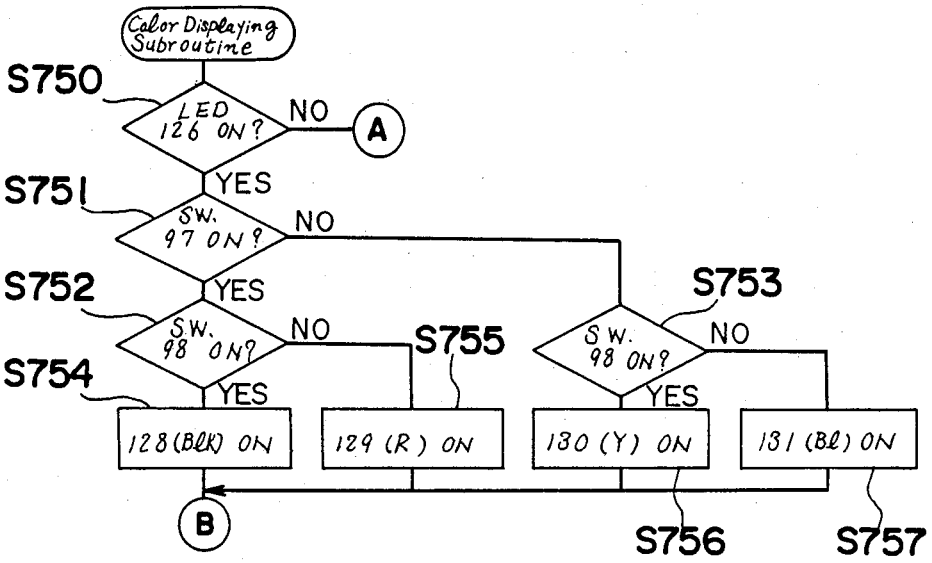
Figure 16B:
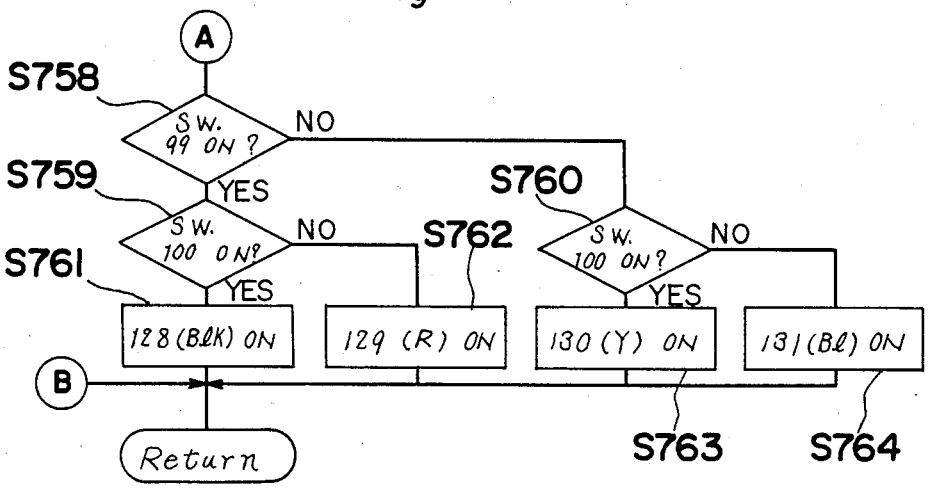

FIGS. 16(A) and (B) show a flow chart of the subroutine for displaying the color of toner which is called in the subroutine for selecting the developing device and the subroutine for displaying toner data.

(i) At step S750, it is decided whether the first indicating LED for the selection of the first developing device was turned on or not. If the LED 126 was ON, namely, the first developing device 5 was selected, the color of toner therein is identified according to the combination of ON, OFF signals of lead switches 97 and 98 through steps from S751 to S753 and the color identified is indicated by the corresponding one of LEDs 128 to 131 at one of steps S754 to S757 and, then, the process is returned to the subroutine for selecting the developing device or for displaying toner data.

(ii) If the first indicating LED 126 was turned off, namely, the second developing device 6 was selected, the process proceeds to S756 skipping steps S751 to S755 and, then, the color of toner in the second developing device 6 is identified according to the combination of ON, OFF signals of the lead switches 99 and 100 through steps from S758 to S760. The color identified is indicated by the corresponding one of LEDs 128 to 131 at one of steps from S761 to S764 and, then, the process is returned to the subroutine for selecting the developing device or for displaying toner data.

*Subroutine for Copying Operation

Figure 17A:
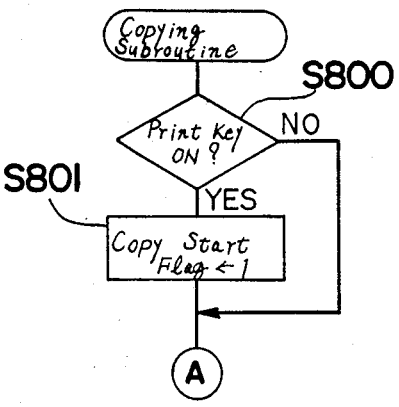
Figure 17B:
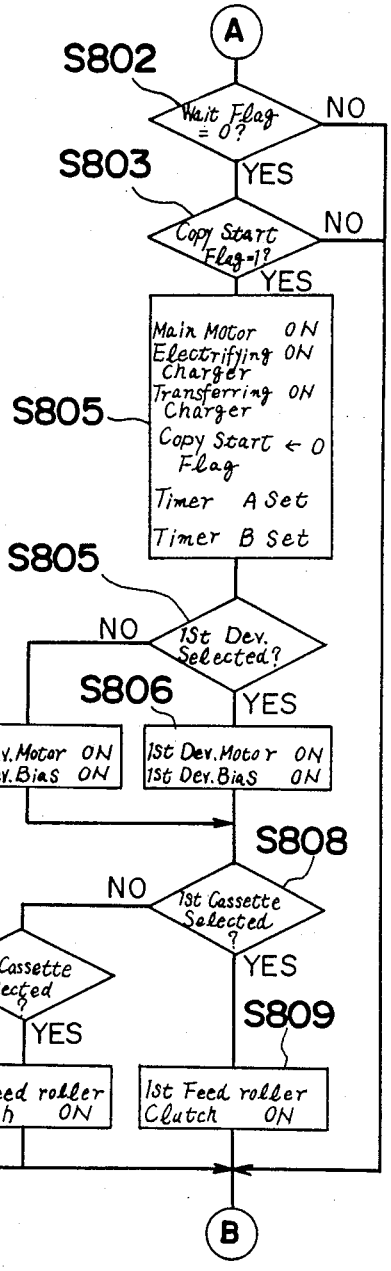
Figure 17C:
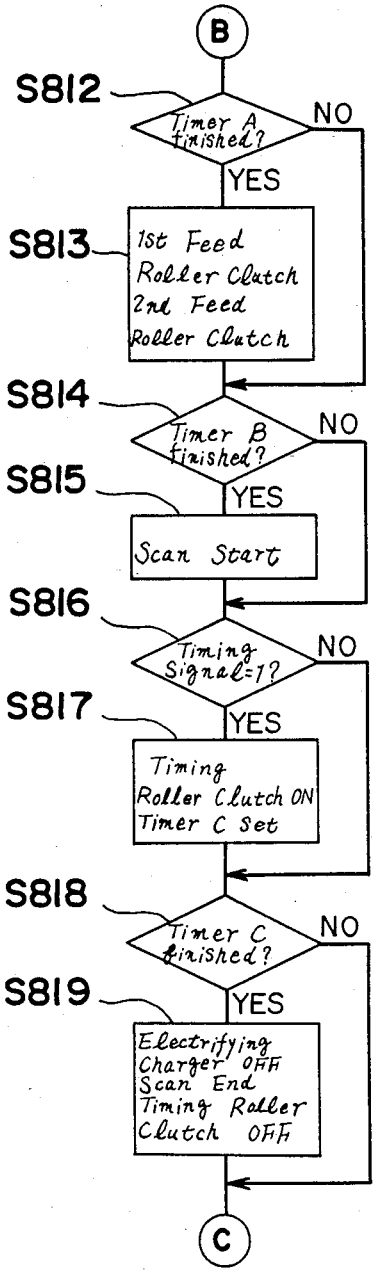

FIGS. 17(A), (B), (C), (D) and (E) show a flow chart of the subroutine for copying operation.

(i) At step S800, it is decided whether the print key 102 was operated or not. If the print key 102 was operated, the copy start Flag is set to "1" at S801 and then, the process proceeds to S802. If it was not operated, the process proceeds directly to S802. The copy start Flag is provided for deciding whether the copy operation is to be started or not and is set to "1" before the start and is reset to "0" after the start.

(ii) At step S802, it is decided whether the wait Flag is "0" or not. If the wait Flag was "0", namely, it was not within the time prohibited after the exchange of the toner bottle, it is decided whether the copy start Flag is equal to "1" or not at step S803. If it was "1", the copy operation is started at step S804.

If the wait Flag was "1" at step S802, or if the copy start Flag was "0" at step S803, the process proceeds to step S812 skipping steps from S804 to S811 since the copy operation is not required.

(iii) If the copy start Flag was "1", the main motor is started to drive at step S804. Therefore, the photosensitive drum 2 is driven to rotate and the individual roller is held ready for driving. Further, the electrifying charger 3 and transferring charger 7 are turned on so as to be capable of transferring the toner image from the photosensitive drum 2 onto a copy paper. Then, the copy start Flag is reset to "0" and the timer A for controlling the paper feeding system P and the timer B for determining the start timing for the scan are both set.

(iv) At step S805, it is decided whether the first developing device 5 was selected or not. If it was selected, the process proceeds to step S806 to turn on the first developing motor and first bias power source. Accordingly, it becomes possible for the first developing device 5 to develop the toner image.

If the second developing device 6 was selected in place of the first developing device 5, the process proceeds to step S807 to turn on the second developing device and the second bias power source is switched on to cause the second developing device to develop.

(v) At step S808, it is decided whether the first paper feeding assembly 28 was selected or not. When selected, the first roller clutch arranged between the main motor and the first feeding roller 33 is switched on to drive said roller and thereafter, a copy paper is fed from the first feeding assembly 28.

(vi) If it was decided that the first feeding assembly 28 was not selected, it is decided whether the second feeding assembly 30 was selected or not at step S810. If it was selected, the second roller clutch arranged between the main motor and the second feeding roller 34 is switched on to feed a copy paper from the second feeding assembly 30. If it was decided that the second feeding assembly 30 too was not selected, the process proceeds to step S812 without driving the first and second feeding rollers 33 and 34 since a copy paper may be inserted from the manual inserting assembly in this case.

(vii) At step S812, it is decided whether the timer A has been counted up or not. If it had been counted up, the process proceeds to step S813 presuming that the feeding of a copy paper has been completed and the first or second roller clutch for the completion of feeding paper is switched off.

If the timer A was not counted up, the process proceeds to step S814, skipping S813.

(viii) At step S814, it is decided whether the timer B has been counted up or not. If it had been counted up, the lamp 12 is turned on and the scanning unit 14 including the lamp is started to scan the original. Therefore, an electrostatic latent image is formed on the surface of the drum by exposing the drum with the light reflected from the original and guided by the optical assembly O.

If it was not counted up, the process proceeds to step S816 skipping step S815, since it is not the time to start the scanning.

(ix) At step S816, it is decided whether the timing signal above mentioned is equal to "1", in other words whether it is the timing for a copy paper to be fed to the photosensitive drum 2 by the timing roller 24. If it was the timing, the timing roller clutch between the main motor and the timing roller 24 is switched on to drive the roller at step S817 and the timer C is set to count the driving time of the timing roller 24.

If the timing signal was not "1", the process proceeds to step S818, skipping step S817.

(x) At step S818, it is decided whether the timer C has been counted up or not. If counted up, the electrifying charger 3 is turned off, the lamp 12 is also turned off, the scanning is completed and the timing roller clutch is switched off to finish feeding the paper by the timing roller.

During these steps mentioned above, the electrostatic latent image on the surface of the photosensitive drum 2 is developed to a toner image by toner in the developer which is supplied by the first or second developing device 5 or 6 and this toner image is transferred onto the copy paper by the transferring charger 7.

If the timer C was not counted up, the process proceeds to step S820, skipping step S819.

(xi) At step S820, it is decided whether the return signal is "1" or not, namely, whether the scanning unit began to return to the starting position thereof.

If the return signal was "1", namely, the scanning unit 14 was driven to return to the starting position, it is decided whether the number of copies at present is attained to the number of copies having been set prior to the operation of the print key.

If it was not attained to, the process proceeds to step S822 to set the copy start Flag to "1" in order to continue or repeat the copying operation.

(xii) If it was attained, it is decided whether the position signal is "1" or not at step S823, namely, whether the scanning unit 14 has been returned to the predetermined starting position. If returned already, it is decided whether the first developing device 5 was selected or not at step S824.

(xiii) If it was selected, the process proceeds to step S825 to execute a so-called auto-shut, namely, to remove residual charge on the drum 2 by the main eraser 10. At the same time, developer in the second developing device 6 having been not used in the above mentioned process is stirred during the auto-shut.

In order for that, the second developing motor is turned on to stir developer therein by the second bucket roller 56 at step S825, while the first developing motor and developing bias power source are turned off. During the stirring process, the second developing bias power source is kept OFF to avoid development by toner agitation.

(xiv) At step S827, the transferring charger 7 is turned off and the timer D for counting the top half time of the auto-shut is set. If it was decided that the timer D was counted up at S828, the process proceeds to step S829 to turn off the second developing motor in order to cease stirring developer therein. Then, the timer E for counting the bottom half time of the auto-shut is set at step S830 and, when the timer E was counted up at step S831, the main motor and main eraser 10 are turned off to finish the auto-shut.

(xv) If it was decided at step S824 that the first developing device 5 was not selected and, accordingly that the second one 6 was selected, developer in the former having been not used is stirred to agitate through steps from S826 to S829 and then, the auto-shut is executed by the main eraser through steps from S827 to S832.

(xvi) At step S833, contents processed until then are output and the process is returned to the main routine.

Although, in the embodiment mentioned above, the developing device not used in a copying cycle is driven to agitate developer contained after the cycle, it is possible to drive the developing device if it was not used for a predetermined number of copying cycles, for example ten cycles.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. In an image forming apparatus in which an electrostatic latent image formed on a photosensitive member is developed and subsequently transferred to a paper, the apparatus comprising;

a plurality of developing means selectively operable for developing the electrostatic latent image, agitating means provided in each of said developing means for agitating developer contained therein, means responsive to a power switch for driving each of said agitating means for a predetermined period of time, means for selecting one of said developing means and driving the same to develop the electrostatic latent image during an image forming cycle, and means responsive to termination of the image forming cycle for at least driving said agitating means of one of the developing means not used in said image forming cycle for a predetermined period of time.

2. In an image forming apparatus in which an electrostatic latent image formed on a photosensitive member is developed and subsequently transferred to a paper, the apparatus comprising;

first and second developing means selectively operable for developing the electrostatic latent image, first agitating means provided in said first developing means for agitating developer contained therein and second agitating means provided in said second developing means for agitating developer contained therein, means responsive to a power switch for driving each of said first and second agitating means for a predetermined period of time, means for selecting one of said first and second developing means and driving the same during an image forming cycle for developing a predetermined number of electrostatic latent images while prohibiting the operation of the other of said first and second developing means, and means responsive to termination of the image forming cycle for driving said agitating means for ones of the developing means prohibited from operation during said image forming cycle for a predetermined period of time.

3. In an image forming apparatus in which an electrostatic latent image formed on a photosensitive member is developed and subsequently transferred to a paper, the apparatus comprising;

a plurality of developing means selectively operable for developing the electrostatic latent image, each of said developing means being detachable from the apparatus, agitating means provided in each of said developing means for agitating developer contained therein, means for detecting attachment of said developing means, and means responsive to said detecting means for automatically selecting the attached developing means and for driving corresponding ones of said agitating means for a predetermined period of time and prohibiting an image forming cycle from beginning.

4. In an image forming apparatus in which an electrostatic latent image formed on a photosensitive member is developed and subsequently transferred to a paper, the apparatus comprising;

a plurality of developing means selectively operable for developing the electrostatic latent image, each of said developing means including agitating means for agitating developer therein and toner replenishing means for supplying toner thereto, means for detecting exhaustion of toner in each of said toner replenishing means, means for automatically selecting ones of said developing means according to a condition being decided from states of exhaustion of toner in all of said toner replenishing means detected by said detecting means, and means for driving said agitating means of the automatically selected ones of said developing means for a predetermined period of time and prohibiting an image forming cycle from beginning.

5. In an image forming apparatus in which an electrostatic latent image formed on a photosensitive member is developed and subsequently transferred to a paper, the apparatus comprising;

a plurality of developing means selectively operable for developing the electrostatic latent image, each of said developing means including agitating means for agitating developer therein and toner replenishing means for supplying toner thereto, said toner replenishing means removably provided in said developing means, means for detecting exhaustion of toner in each of said toner replenishing means, means for automatically selecting developing means upon attachment of said toner replenishing means filled with toner, and means for supplying toner from the toner replenishing means and driving said agitating means of the automatically selected developing means for a predetermined period of time and prohibiting an image forming cycle from beginning.

* * * * *